US008277065B2

(12) United States Patent
Camarillo Fernandez et al.

(10) Patent No.: US 8,277,065 B2
(45) Date of Patent: Oct. 2, 2012

(54) ILLUMINATION SYSTEM FOR CAVITIES

(75) Inventors: Oscar Tomas Camarillo Fernandez, Santiago de Queretaro (MX); Jose Alejandro Orozco Vazquez, Santiago de Queretaro (MX); Antonio Lopez Juarez, Santiago de Queretaro (MX)

(73) Assignee: Mabe, S.A. DE C.V., Queretaro (MX)

( * ) Notice: Subject to any disclaimer, the term of this patent is extended or adjusted under 35 U.S.C. 154(b) by 227 days.

(21) Appl. No.: 12/837,782

(22) Filed: Jul. 16, 2010

(65) Prior Publication Data

US 2011/0149551 A1 Jun. 23, 2011

(30) Foreign Application Priority Data

Dec. 18, 2009 (MX) ..... MX/a/2009/014046

(51) Int. Cl.
*F21V 33/00* (2006.01)

(52) U.S. Cl. ..... 362/92; 362/311.01; 362/311.02

(58) Field of Classification Search ..... 362/92, 362/311.01, 311.02; 219/391
See application file for complete search history.

(56) References Cited

U.S. PATENT DOCUMENTS

| | | | | |
|---|---|---|---|---|
| 6,361,181 | B1 | 3/2002 | Bales | |
| 6,402,347 | B1 | 6/2002 | Maas et al. | |
| 6,547,400 | B1 | 4/2003 | Yokoyama | |
| 7,001,022 | B2 | 2/2006 | Kim et al. | |
| 7,157,667 | B2 | 1/2007 | Gramlich et al. | |
| 7,331,694 | B2 | 2/2008 | Lee et al. | |
| 7,731,402 | B2 | 6/2010 | Tessnow et al. | |
| 2004/0264168 | A1 * | 12/2004 | Gotz et al. | 362/92 |
| 2006/0049188 | A1 * | 3/2006 | Gramlich et al. | 219/723 |
| 2009/0272136 | A1 * | 11/2009 | Knoll et al. | 62/251 |

* cited by examiner

*Primary Examiner* — Evan Dzierzynski
(74) *Attorney, Agent, or Firm* — Enrique J. Mora; Beusse Wolter Sanks Mora & Maire, P.A.

(57) ABSTRACT

A system to light a cavity 19 in an appliance. A source or light emitter 27 is mounted on a circuit board 32, so that the light emanating from said source or light emitter 27, is concentrated into a light beam using an optical collimator system 28 or in some cases a Fresnel arrangement; wherein the foregoing elements may be found outside a door 14, which allow access into the cavity; thus the light beam exiting the optical collimator 27 or Fresnel arrangement travels a distance though air between the optical collimator system 27 or Fresnel arrangement and the upper face of the light guide 29 which is placed on the door 14, the light guide 29 transports the luminous flux towards a notch which diverts said luminous flux directing into the cavity's 19 interior.

11 Claims, 10 Drawing Sheets

ILLUMINATION SYSTEM FOR CAVITIES

RELATED APPLICATIONS

This application claims priority from Mexican application Serial No. MX/a/2009/014046 filed Dec. 18, 2009, which is incorporated herein by reference in its entirety.

FIELD OF INVENTION

The present invention lies in the field of electric household appliances, in declarative form but not limited to stoves, kitchens, ovens, ovens' cavities, refrigerators, washers, dishwashers or any other type of cavity with a door which allows a view into its interior.

BACKGROUND

Derived from an analysis, it was determined that the best way to light a cavity is through its front side, that is, it is best to align the luminous flux with the observer's view path. In this way, the beam of light in any given cavity whose access door contains translucent panels shall be lit from the front. With this in mind, several alternatives can be considered, such as placing light sources on the border of lateral, superior, inferior or all walls. Up to this point, this idea makes sense, the problem arises when said cavity is heated and the light sources are overheated and thus damaged. Another possibility could be to place the light source or bulb in any of the side or upper walls. This reduces usable space in the cavity, additionally creating a risk, as it is likely that the objects being placed in the cavity will knock against the bulb.

We can continue devising areas to place the light source or find references to previous art which are listed illustratively in order to establish where the state of technology currently lies in the field.

Michael E. Bales' U.S. Pat. No. 6,361,181 describes a household oven's cavity which is comprised of a particular bulb as its light source, which is lodged in the interior part of the window pack. Said window pack traditionally has a rectangular shape whose sides have some translucent material, preferably glass. Said window pack, among other functions, allows the user to view the oven cavity's interior in addition to isolating heat from the exterior, achieving this by trapping air between panels, sheets or laminates of translucent materials and the rectangular ring. In this way, said packet can lodge a socket assembly and bulb, as these are traditionally made of metal heat-fixed insulators, as well as glass among others. These materials are well known to resist high temperatures. Thus, all would point towards Bales' lighting system as being an effective one. This is partially true, as only a certain amount of lumens can be drawn from a bulb based on an incandescent filament, which causes part of the energy which it uses, to be transformed into heat, thus rendering it energy inefficient. Additionally, there is the problem of conducting the energy to the bulb's socket, which is carried out by means of electric conductors. These have to be specially tailored given the high temperatures which it must withstand, making the design more expensive. Additionally, said document describes said conductors as passing near to or on the sides of the hinges, creating a potential risk given that the electric conductors can be pinched, sheared or crunched by the hinges placing the operator at risk of electric shock, thus making this design far from acceptable.

Another effort is described in Gramlich et al's U.S. Pat. No. 7,157,667 which sets forth a better solution than the previous document, in which a light source is placed in the oven's lower area under the muffle, wherein the light source is placed at such an angle that its light is reflected to a mirror which in turn reflects the beam of light towards other mirrors. The disadvantage of this system is that the mentioned beam of light, in having to travel a considerable distance through air, can be altered due to differences in air density coupled to this system's assumption that the air circulating through the window is "clean", that is, not containing fumes, smoke or particles, which allows light to be homogeneous or uniform during its path, scattering or dispersing said beam and losing light intensity on its path; as well as said mirrors needing maintenance because if they are not clean, they will be unable to reflect the beam of light incident upon them, causing a significant decrease in the amount of reflected lumens.

Therefore, the present invention serves as a means to greatly alleviate the above mentioned inconveniences as well as others to be described later, these being the objective of the present invention.

BRIEF DESCRIPTION OF THE INVENTION

Where the present invention can be used in any cavity, whether a refrigerator's, oven's, cabinet's, washer's, dishwasher's etc. for the intent of this description, it will be coupled to an oven's cavity. However, this shall not limit its spectrum of use to any other type of cavity which contains a front door with a translucent plate arrangement which offer a view into its interior.

Ovens, kitchens, refrigerators, washers, dishwashers, household ovens and in particular almost all cavities generally have a floor, a roof, side walls and a back wall, thus the door is perpendicular to the back wall, the door can be fastened by hinges, for example, on a refrigerator's door, the doors can rotate on a vertical axis, in the oven's case, they rotate on a horizontal axis, but back to the oven's embodiment, a burner is located just under the cavity's floor, which can be electric or gas, in some cases, depending on the type of oven, a burner can be found hinged to the oven cavity's roof, wherein a bulb is commonly found on the back wall near the upper corners, which has the inconvenient function of lighting the cavity's back part, impacting the light source in front of the operator, in addition to lighting the objects placed in the cavity on their back side creating a shadow in front of them, thus creating deficient lighting being cast on the objects themselves. Also, a fan is sometimes placed on the back wall which generates forced convection. The side walls typically have a series of protuberances or ribs on which grills are placed which hold the objects being placed in the cavity, and in some instances, said grills can have runners or another type of mechanism which allow for easy removal and placement into and out of the cavity.

The oven cavity's door includes a series of plates or sheets of a translucent material, generally glass, with some treatment on its surface such as an anti-reflective or window tint. The series of glass plates or sheets are stacked in parallel fashion and between them some supports or frames (depending on the design of each door) which fasten the series of plates or sheets in parallel fashion. Additionally, isolating thermal elements are placed between said series of plates or sheets which slow down the transfer of heat to the plate or glass which is exposed to the exterior, with the goal of preventing the operator from getting burnt. Also, some designs have a space between the glass plates or sheets, so that via a series of windows placed both on the lower and on the upper parts of said door, a current or air mass can circulate which allows for the cooling or pulling heat away from the door itself. The oven's cavity being discussed is generally secluded within a cabinet, so that the oven's own doors have some form of thermal isolating which will slow down or dissipate heat flow towards the exterior. The cabinets can be of various designs, from structures based on an extruded profile or lined with panels or simply have panels attached to their ends. Also, between the cabinet and the oven's cavity there are a series of ducts which allow the burners to draw in air as well as mufflers or ducts which extract combustion gases, which must be transported toward the cabinet's exterior.

Keeping the above in mind, generally a board or facade is found just above the door, and in case the oven is part of a stove or kitchen, this is wherein the knobs which control the gas regulating valves are found; precisely in the same space used to place the electronic cards or controls since this is the exact area which is not exposed to high temperatures and is also in the front which also helps place user interface. In this area, where an electric control is placed with a switch to power a light source, which can be in declarative but not limited form: a bulb, an LED (light emitting diode), a laser diode, an electroluminescent organic element, a field emission display, among others. Said light source can be coupled to an optical collimator system, or in an alternative embodiment can even have a Fresnel arrangement. The optical collimator system is preferred in this case particularly given the LED's arrangement; since these are generally surrounded by a type of bubble which not only isolates the emitter from the environment, but also has an optical effect on the beam of light formed by the emitter upon opening, so it is necessary to concentrate it, knowing that the present invention requires a concentrated light beam in order to be able to jump the distance from the optical collimator system's exit to the light guide, this with the purpose of preventing particles, dirt found in air or even air's own density, from allowing the light system discussed in the present invention to function properly. Grasped on to the interior frame or interior structure of the door, there is a light guide, preferably made of glass, as this is an inexpensive material, easy to manufacture and can withstand high temperatures among other attributes. However, in situations with no high temperature restrictions a type of thermoplastic translucent can be injected. This way, the light source can concentrate into one beam thanks to the collimator system, said beam being received through the upper part of the light guide so that it can be transported the length of the light guide which runs the length or height of the oven's door, where, the light guide, like a flute, has a series of incisions with a predetermined angle which can direct the appropriate amount of light towards the oven's cavity. Thanks to this design, one can have a greater amount of light exits for the guide light, since a system with mirrors, for example, is restricted to a lesser amount of light since this depends directly on the lining up with the light source or primary reflector as well as the distance to them: a situation that does not occur with the light guide, as efficiency is drastically increased since the light guides transport light with less losses due to the longitude or transport.

BRIEF DESCRIPTION OF THE DRAWINGS

These and other characteristics, aspects and advantages of the invention presently being discussed, will be better understood upon reading the detailed description referencing the accompanying drawings, of which.

DETAILED DESCRIPTION OF THE INVENTION

Figure 1:
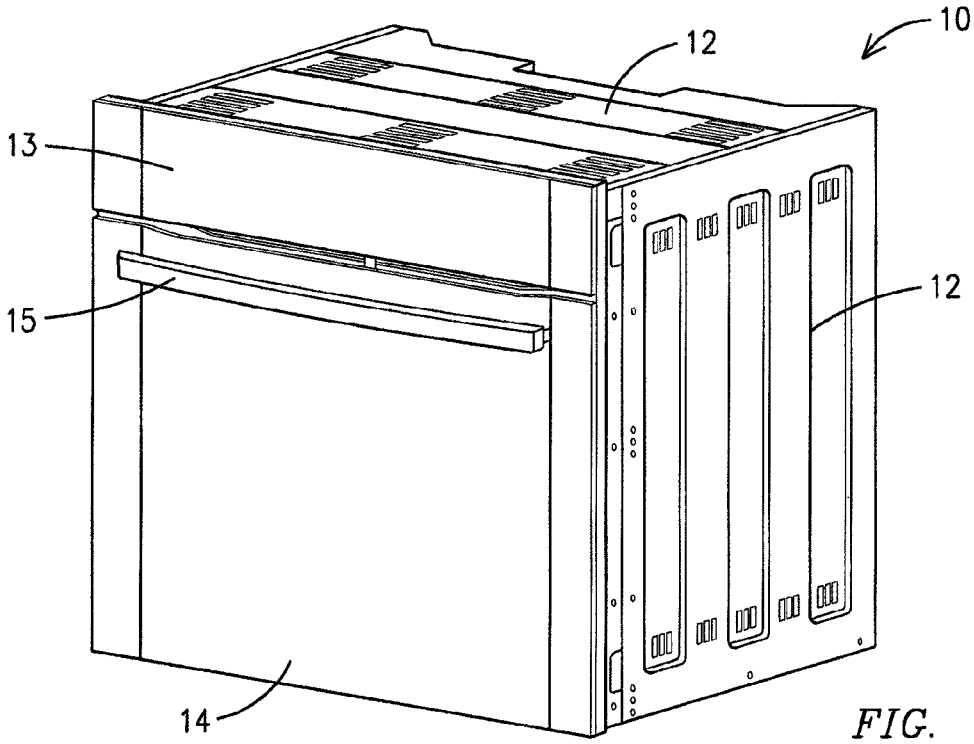
FIG. 1 is an isometric view of a household oven.
Figure 2:
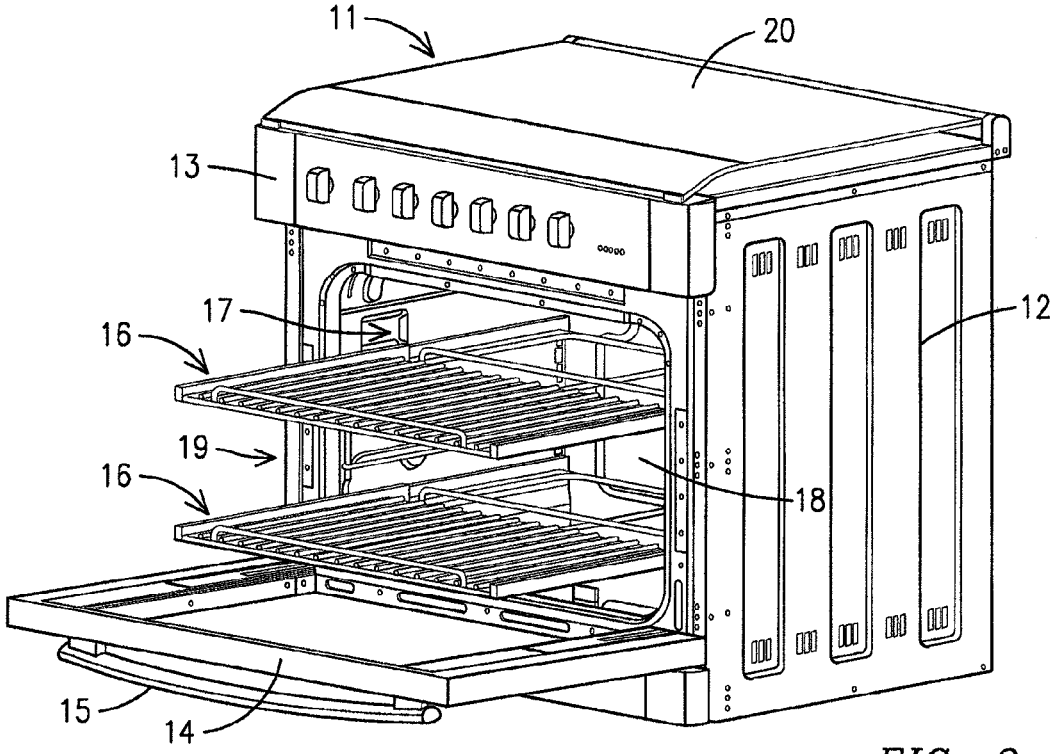
FIG. 2 is an isometric view of a stove or kitchen with an open door and extended grills.

FIGS. 1, 2 show both an oven 10 or stove or kitchen 11, wherein both have lateral panels 12, a front side with knobs or board 13, a door 14 with a pull handle 15, FIG. 2 even allows for a glimpse of the grills 16, as well as the side wall 17, the back wall 18 and the cavity 19. The specific model shown also consists of a hat 20, which covers the top burners (not shown).

Figure 3:
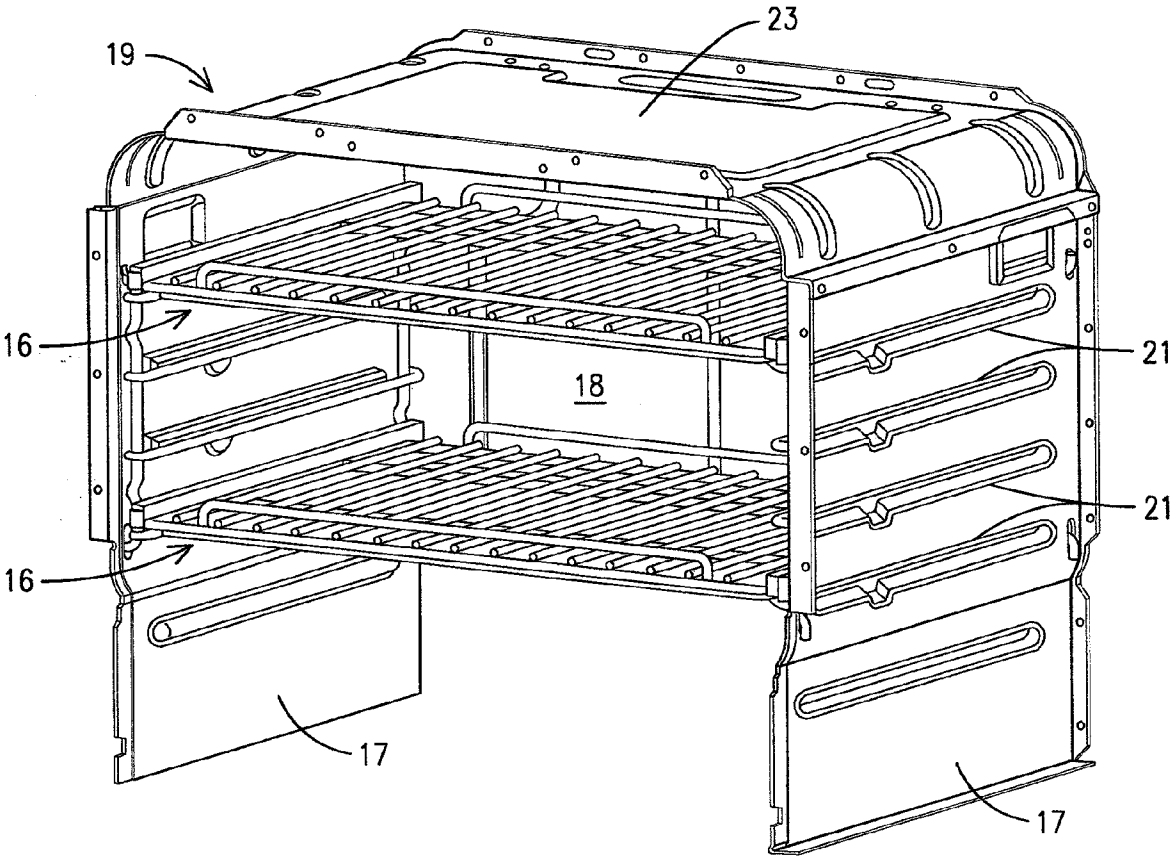
FIG. 3 is an isometric view of a household oven's cavity with grills and no floor.

FIG. 3 shows an oven's cavity 19, without a bottom floor 22, from where a glimpse of the grills 16 can be seen, the side wall 17, the back wall 18 as well as the embedded grills 21, in an alternative embodiment, the grills 16 can be mounted on tracks or any other type of mechanism which allows a horizontal sliding movement with ease. The side walls 17 as well as the back wall 18, the bottom floor 22, and the roof 23 are preferably made of inlaid steel with a ceramic or anti-adhesive finish, which can be achieved by an inlay and imprint process. The grills 16 themselves are also made of steel and refinished with an anti-adhesive, shiny material. The side walls 17 connect with the roof 23 either by rivets or screws or welding, thanks to some flange placed for this purpose, the bottom floor 22 being assembled in a similar fashion, as well as the back wall 18, and the whole assembly is covered on its exterior by a thermal insulator (not shown) which restricts and distributes heat's path towards the panels 12. Just under the floor 22, a burner is placed (not shown) and in some modalities of ovens 10, kitchens or stoves 11, there can be another burner assembly placed in the interior roof's facade 23.

Figure 4:
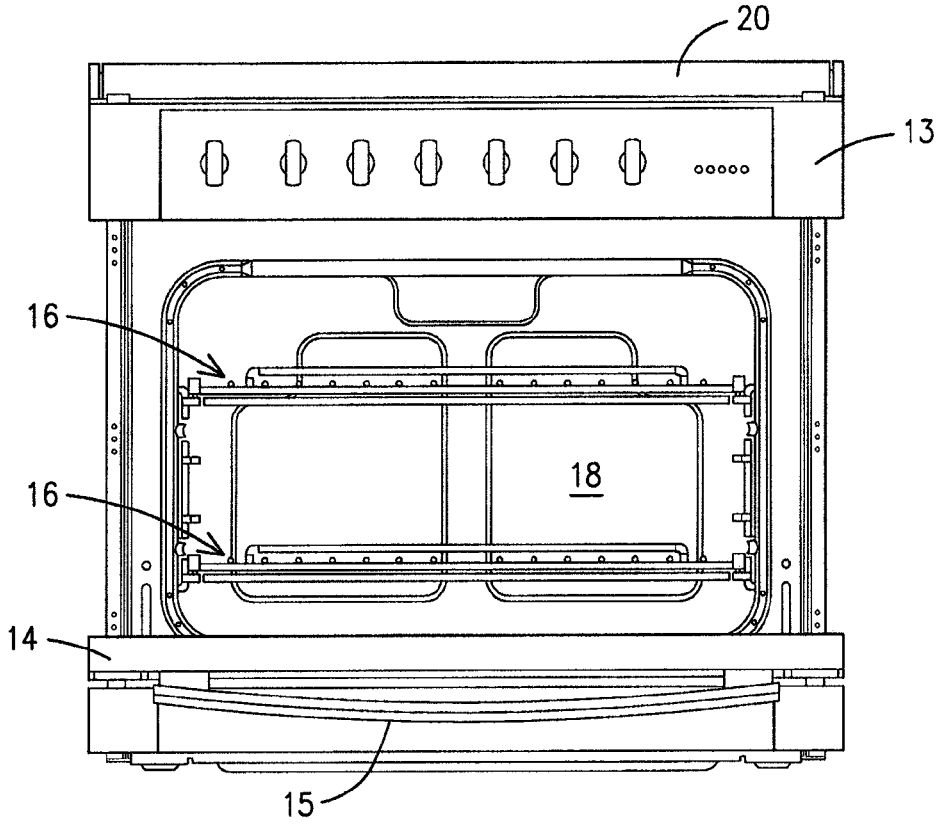
FIG. 4 is a frontal view of a stove or household kitchen with the door in downcast position.

FIG. 4 allows a view of a cavity 19, specifically an oven or kitchen 11 cavity 19, wherein it can be seen that if a light source or bulb were to be placed on the cavity's 19 back wall 18, said light source would directly impact the operator's eyes, causing glare, wherein the objects placed on the grills 16 will be lit from their back sides causing a shadow cone to be cast on the operator's view, resulting in deficient lighting which can in turn cause the operator to make incorrect decisions on proper cooking stage or heating of the objects placed on the grill 16 inside the cavity 19.

Figure 5:
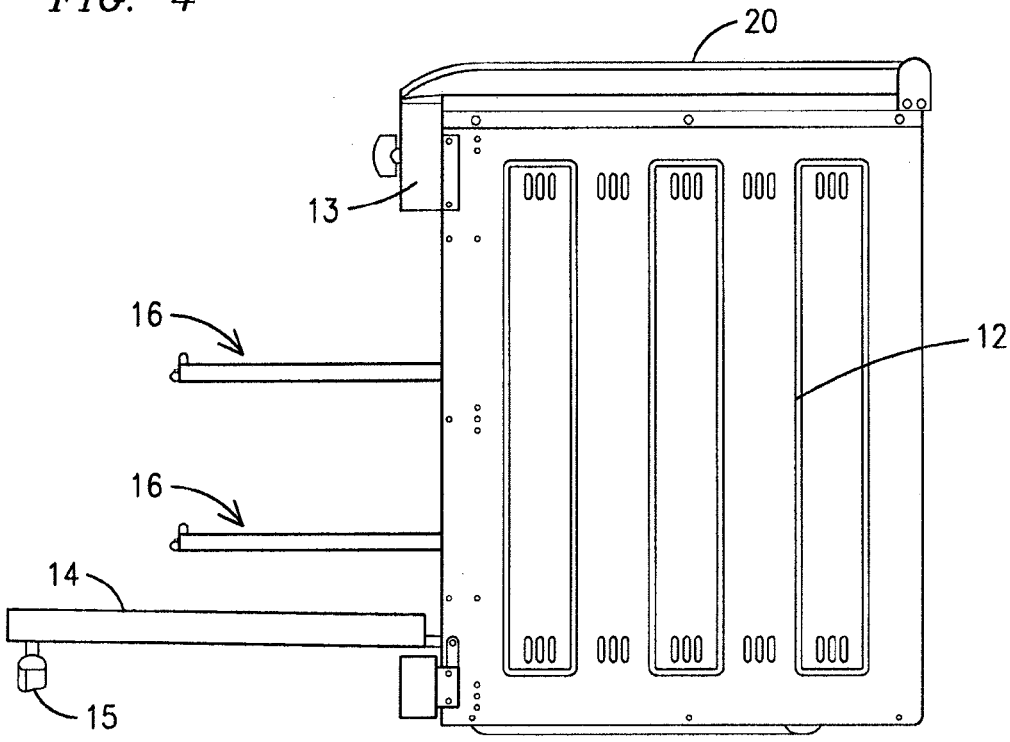
FIG. 5 is a lateral view of a stove or household kitchen with the door in a fully downcast position and extracted grills.

FIG. 5 is a lateral view of a kitchen or stove 11 with the door 14 in a complete downcast position and the grills 16 pulled out, this figure helps explain that if one or a series of bulbs are placed on or inside the door 14, the cords which feed the bulbs or light source must pass near the hinge 25 (not shown), wherein said conductors could be pinched by said hinge 25, exposing the operator to potential electric shock. Additionally, the electric conductors mentioned on several occasions shall be lined with an insulating material resistant to high temperature. Thus the present invention eliminates the inconveniences mentioned above by placing an electronic control 26 in front of the knobs or electronic panels 13 which have a handle which controls energy flow to an emitter or source of light 27 which is preferably an LED (light emitter diode) coupled to an optical collimator system 28, this assembly is placed in the area in front of the knobs or board 13 since this space which includes these front knobs or board 13 is not exposed to high temperatures which helps in the optimal function of the electronic control 26 as well as that of the light source 27. A light guide is placed on the door's length between the exterior glass and the interior glass; this light receives the concentrated light beam from the optical collimator system and directs it toward the cavity's interior 19.

Figure 6:
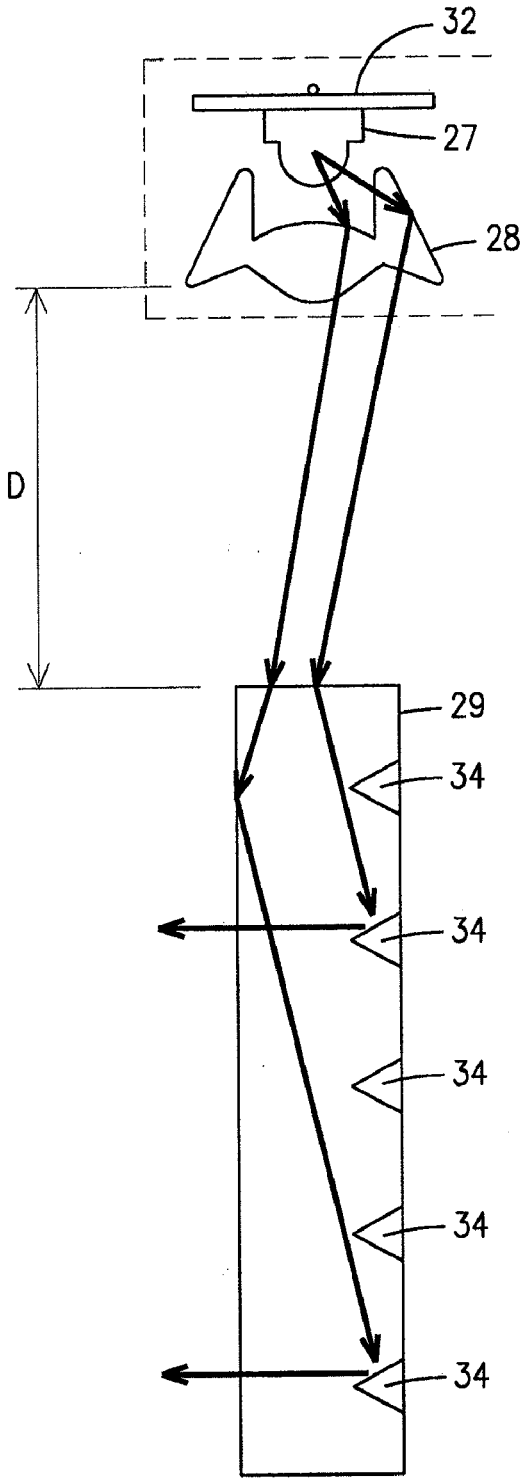
FIG. 6 is a diagram of the concept.

FIG. 6 is a concept diagram of the light's travel from the source to the cavity 19. Held on to the printed circuit board (PCB) 32, the light emitter 27 which is driven by a handle or switch controlled by the electronic control 26, wherein the electronic control sends a signal to the handle or switch to allow the flow of energy to the light emitter 27. In this way, it is powered and emits light due to the bubble which surrounds the light emitter which is dispersed all around it. In this way, the optical collimator system 28 picks up the light rays which the light emitter or source 27 emits in all directions and concentrates it into one sole beam which is cast on the upper horizontal face of the light beam 29, traveling a distance "D" between the optical collimator system and the upper horizontal face of the light guide 29, and now the light beam "fills" the internal volume of the light guide 29 with light, which is in turn then directed towards the cavity 19 by means of the notches 34. In this way, with this system, the electronic system is understood as comprised by the electric control 26, the handle, the printed circuit board 32, as well as the emitter or light source 26, in a relatively cold place which do not exceed operational temperatures for the electronic system thus guaranteeing maximum system function, avoiding power cables or complicated assemblies being placed on the door.

Figure 7:
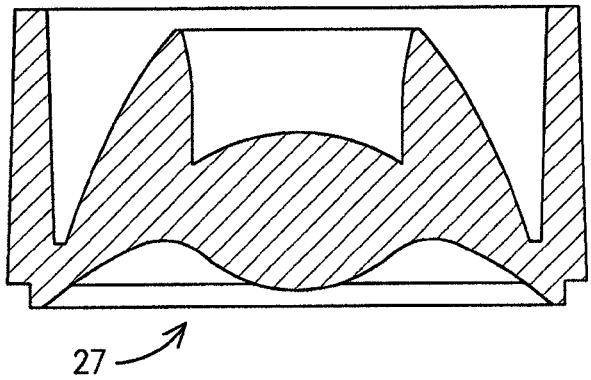
FIG. 7 is a cross section of the collimator system.

FIG. 7 shows a cross section of the optical collimator system 28, which can be replaced in an alternative embodiment by a Fresnel arrangement or any other optical arrangement which collects light emitted in all directions by the emitter or light source 27 and helps create a light beam which shines on the upper horizontal face of the light guide 29.

Figure 8:
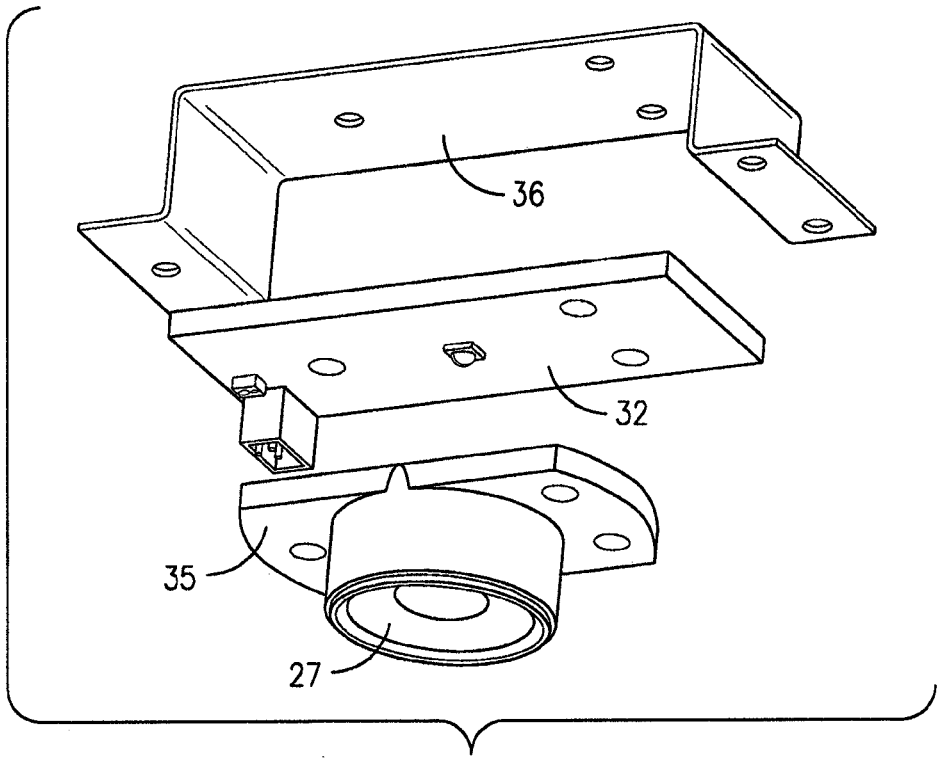
FIG. 8 is an exploded view of the collimator system, the electronic card or PCB and its support.
Figure 9:
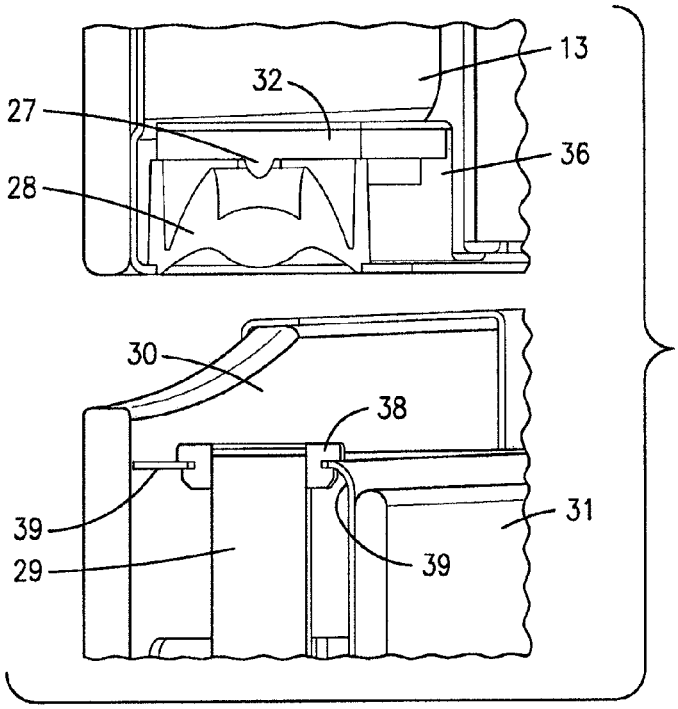
FIG. 9 is a detailed view of the cross section of the source or emitter system-collimator and light guide.
Figure 10:
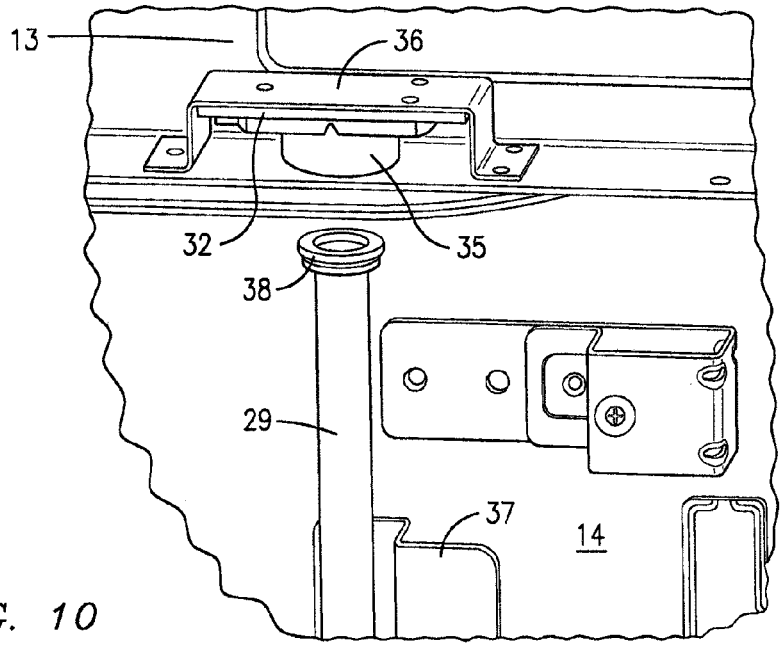
FIG. 10 is a detailed isometric view of the source or emitter system-collimator and light guide.

FIG. 8 shows the assembly of the optical collimator system 28, which is embedded in a support 35, which can be made of a thermoplastic material, creating the piece via injection, or the optical collimator system 28 can be over-molded to obtain a single piece, so that the support 35 assembly plus the optical collimator system 28 is grasped to the printed circuit board 32. In a preferred embodiment, the printed circuit board 32 itself comprises a cooling plate 33 with fins, this cooling plate 32 helps dissipate the heat generated by the emitter or light source 27 when converting electric energy into light energy. This assembly is held by a fastener 36, which can be obtained from a stamped, folded or inlaid metallic sheet, in such a way that it holds the previously mentioned assembly to the interior frame of the front knobs or board 13 thanks to the flange which can be bolted, riveted, dotted, etc. (see FIG. 10).

In an alternative embodiment of the invention the fastener 36 itself can serve as a cooling plate 33 if it's made of aluminum, or in a an alternative embodiment of the invention, said fastener 36 can have fins or have a cooling plate 33 attached or connected to it with or without the presence of fins.

FIGS. 9, 10, 11, 13, 14 show the assembly's lighting system by means of a light guide, object of the present invention. A way to accomplish the invention is to use a door structure 14 such as the one shown in FIG. 11. Yet another way to carry through the invention is to use a door structure 14 such as the one shown in FIG. 12. This way, a myriad of ways to build a door which allow a glimpse of the cavity's interior can be found, for this reason, said structures need to be perceived in declarative but not limited way, since the support 37 can be grasped to any internal structure which separates the glass 30 and 31, or can even be grasped by means of a binder or any means of grasping mechanism to any of the referred to glasses 30 and 31, this being the only design restriction, that is, the guide light must be placed between the glass (or translucent plates or sheets) 30 and 31.

Figure 11:
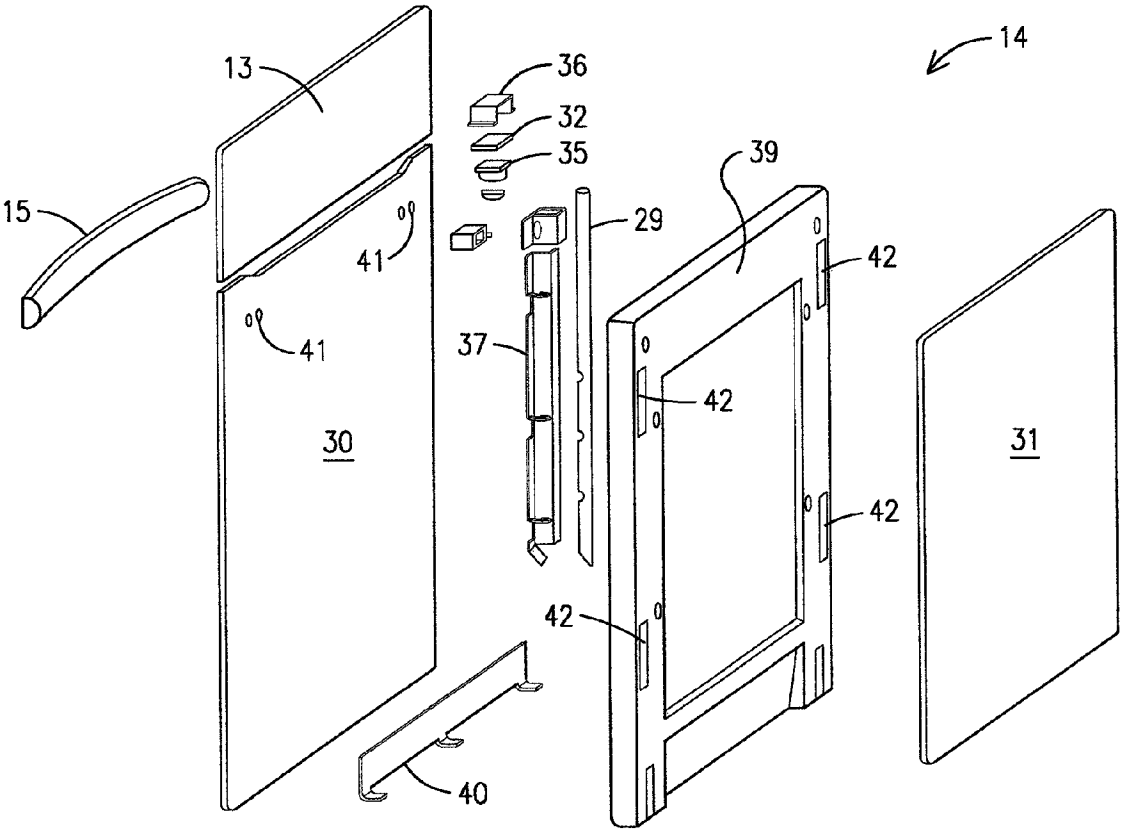
FIG. 11 is a detailed view of the back door's view.
Figure 12:
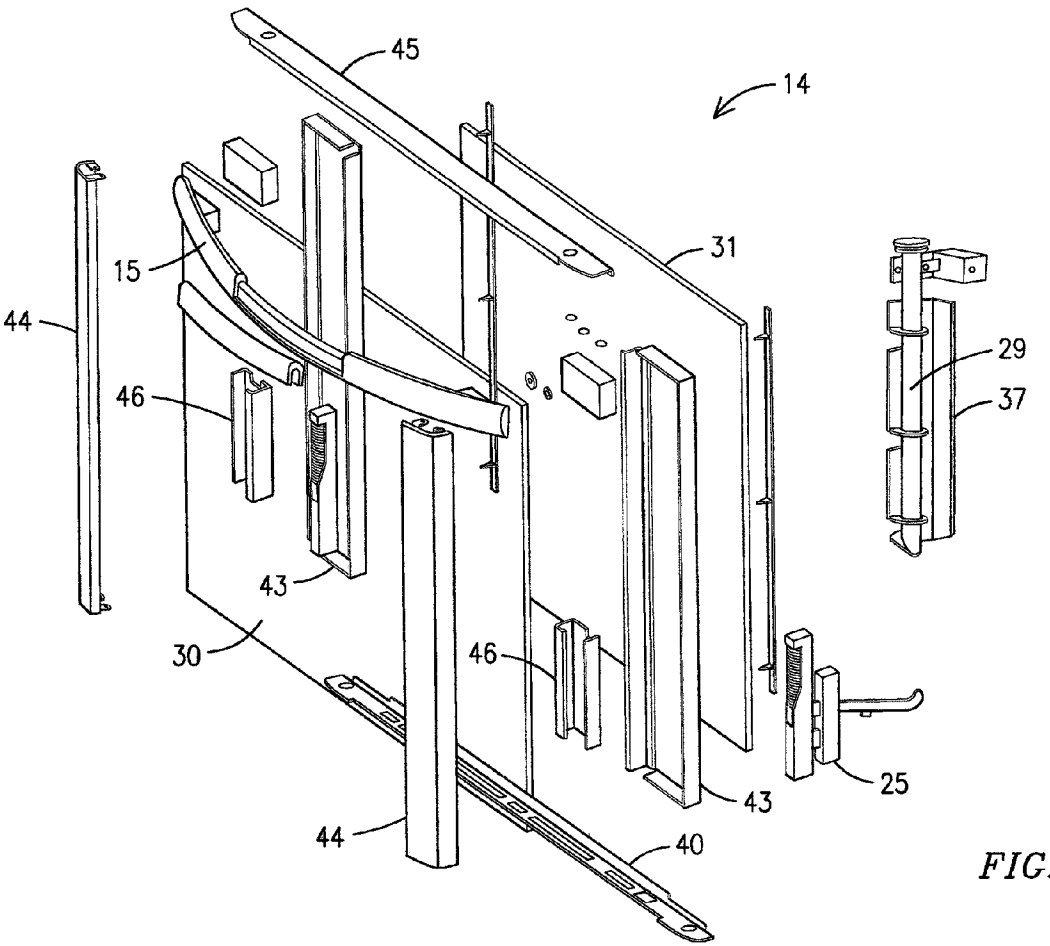
FIG. 12 is a cross section of the oven's door.
Figure 13:
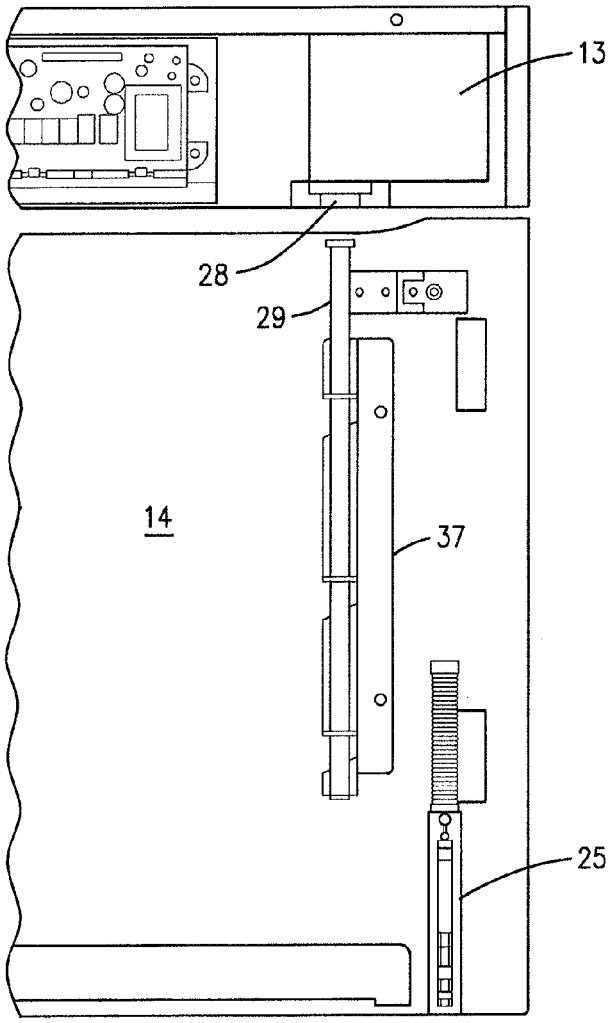
FIG. 13 is a lateral view of the light beam.
Figure 14:
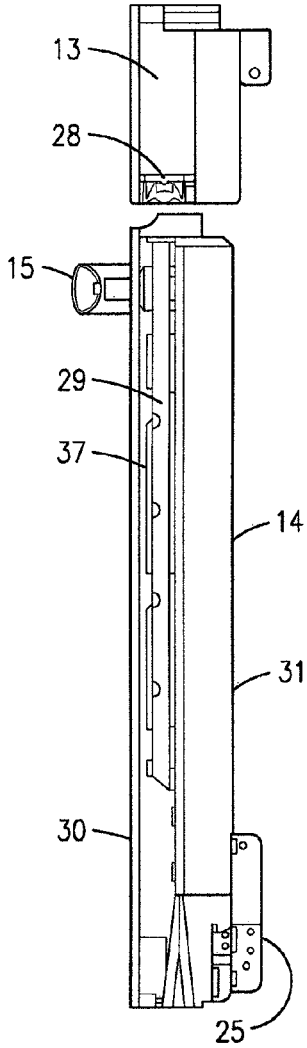
FIG. 14 is a detailed view of the light beam's notches.

As a mere illustration of how to carry out the present invention, the door structure 14 shown in FIGS. 11 and 12 shall be described. FIG. 11 shows an exterior glass 30 which consists of holes 41 through which the fasteners (not shown), which could be screws, must slide through. The handle 15 consists of holes which are aligned to the holes 41, wherein the fasteners are inserted into the holes in the handle 15, and these also go through the holes in the exterior glass 30 until they reach the structural frame 39 to which they are anchored. Upon tightening or adjusting the fasteners, the handle 15 is assembled to the exterior glass 30 and to the structural frame 30. The lower part of the exterior glass 30 is fastened by means of an inferior crossbar 40 which can be grasped by any fastening means (screws, rivets, etc.) to the lower side of the structural frame 39, trapping the exterior glass 30 in between, thereby limiting its degrees of freedom. The light guide assembly 29 and the support 37 are placed by means of a grasping mechanism (screws, rivets, binders etc.) on the inner face of one of the beams of the structural frame 30, preferably on the inner face of the vertical beams, with the understanding that the light source assembly 27, with printed circuit board 32 and fastener 36 are placed in front of the knobs or board 13.

In an alternative embodiment, this last assembly can be placed on the structure itself or the panels 12 horizontally, and given this, the light guide 29 must be placed horizontally aligned with the optical collimator system 28 and the light emitter source 27. Once the support assembly 37 is placed with the light guide 29 on one of the beams of the structural frame 39, the exterior glass panel 31 is placed with the aid of a grasping mechanism (screws, pin-resilient trap, binder, rivet, etc), said fastening means are lodged within the depressions 42 present for that very purpose.

However, FIG. 12 shows a different type of door structure based on a pair of beams 43 instead of the structural frame 39. Said beams can be made of steel or any other type of metallic material since they have to withstand high temperatures without losing its mechanic characteristics. The same applies to the above mentioned structural frame 39. This way, the beams 43 referred to previously, can be inlaid or imprinted or even an extruded tube with a particular cross section which helps support and lodge the glass 30 and 31 can be used. Thus, the handle 15 is coupled to the exterior glass 30 by means of grasping or binding mechanisms, which is followed by the exterior glass 30 already with the fastened handle 15 being placed on the beams 43 which have rabbets or flanges which lodge the exterior glass 30, limiting its axial movement on the X axis, but allowing it to slide on the Y axis, the downward movement on the Y axis being limited by the lower crossbar 40. On above mentioned beams 43 exposed interior side, a light guide assembly 29 is placed as well as a support 37 by means of a fastening mechanism (screws, rivets, binders, etc.) so that the light guide is parallel with the Y axis as well as to the planes described by the glass panels 30 and 31. This allows the guide light mentioned above, to align with the light beam from the light emitter 27, when the door 14 is in a closed or vertical position. Then the hinges 25 are placed with their counterparts 46, which help strengthen the lower part of the beams' 43 assembly by means of a fastening mechanism (screws, rivets, etc.). A glass 31 is then placed on the back side of the beams 43 taking advantage of the rabbets or flanges present for this purpose, wherein said glass 31, can be screwed, riveted, pinned and resilient trap used or any other binding mechanism used as well. Lastly, an upper crossbar 45 which traps the glass 30 and 31 can be placed in the same way as that of the lower crossbar 40; both crossbars are screwed, riveted or glued on to the beams 43.

FIGS. 9, 10, 13, 14 allow a glimpse into the present invention's lighting system's position on a cavity's 19 door 14, so that the assembly (referred to in FIGS. 13 and 14 with number 28 for simplicity's sake) is composed of the fastener 36, the light source or emitter 27, with its printed circuit board 32 and optical collimator system 28 being placed on a flange on the front knobs or board 13, it is also understood from the figures being discussed that the light guide 29 is placed on a structural member or on any of the glass plates 30 or 31, thanks to its support 37 which must be aligned with the same optical collimator system 28 in such a way that the referred to guide light 29 is able to receive the light beam being emitted by the light source 27. Given that the referred to guide light 29 can be a glass bar with notches 34, in an alternative embodiment of the present invention, a support system 37 of an o-ring 38 can be found, which is placed in the hole through which the light guide 29 will have to slide through, or in an alternative embodiment from the present invention, the referred to o-ring 38 can be placed in the hole of the structural frame 39 through which said light guide 29 is slid through (see FIG. 9). Also some type of material which can absorb vibrations or dynamic charges generated during transport can be placed, thus preventing knocking between the lower part of said light guide 29 and the support base 37 (see FIG. 17).

Figure 15:
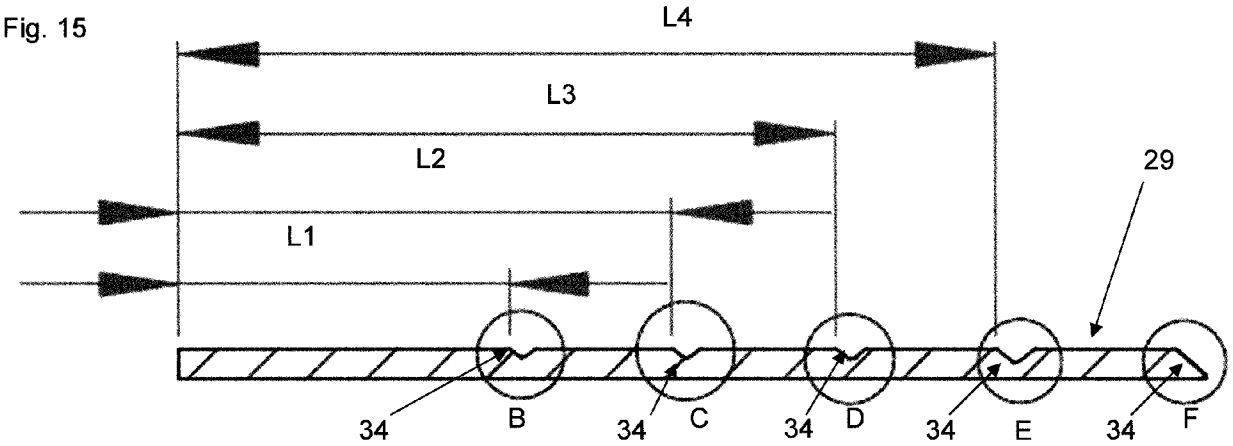
FIG. 15 is an isometric view of the light beam and its support.
Figure 16:
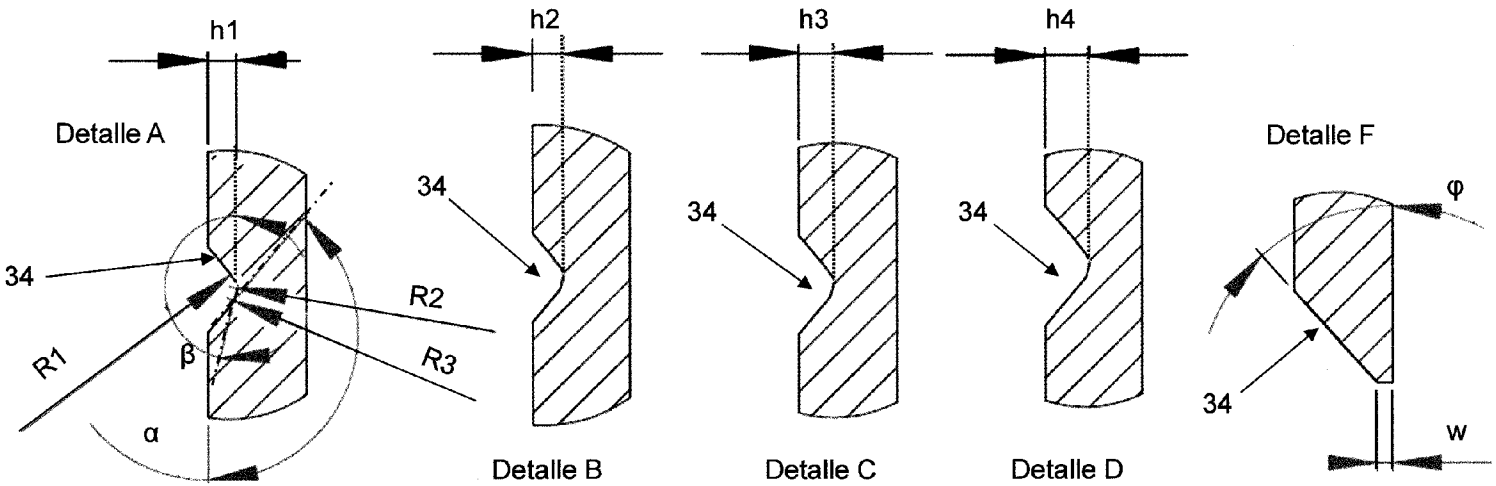
FIG. 16 is a detailed view of the notches on the light beam.

FIG. 15 shows a cross-section of the light guide 29, which is useful to highlight the different lengths L1, L2, L3, L4, in which the notches 34 are found, being obvious that the referred to lengths as well as the number of notches 32 vary depending on the cavity's 19 and door's 14 size. FIG. 16 shows; Detail B, Detail C, Detail D, that depth h1, h2, h3, h4 of the notches 34 increases, in this particular case being able to better describe the execution of the invention, but never in a limited way, in h1 the dimension ranging between 3.5 mm and 4 mm; h2 has a dimension which varies between 3.7 mm and 4.2 h3 has a dimension ranging from 4.1 mm to 4.6 mm; h4 has a dimension which varies between 5.4 mm and 5.9 mm, where L1 has a dimension which varies between 120 mm and 130 mm; L2 a dimension which varies between 180 mm and 190 mm; L3 has a dimension varying between 245 mm and 255 mm; L4 has a dimension which varies between 305 mm and 310 mm; for a bar which varies in length between 380 mm and 400 mm, and a diameter around 12 mm. The notches must follow the geometry exposed in Detail A in FIG. 16, with the obvious exception of the depth of the notch 34 (h1, h2, h3, h4), which have already been discussed above and vary according to the location "1" they have along the length of the light beam 29. Therefore the surface R1 is a curved arch which describes a plane which when projected on the light beam 29 which has a dimension varying between 50 mm and 55 mm, where said surface can be attained by molding or even some method and machinery known for material stripping, particularly glass, wherein said surface is sanded and has null roughness, with the purpose of obtaining maximum reflectance from it when the light torrent is cast on it. The surface identified as R2 which is found deep within the notch 34 and is joined to the deepest part of the notch 34 of the R1 surface, wherein said surface R2 also refers to a plane which follows an arch circumference projecting on the bar 29 which can have a dimension between 0.3 mm and 0.6 mm, wherein said surface R2 can be attained by molding or even some method and machinery known for material stripping, particularly glass, wherein said surface must be sanded and have null roughness, with the purpose of obtaining maximum reflectance from it when the light torrent is cast on it. The plane described by R2 surface is intersected by a plane described by a straight line which has an angle β which varies between 160° and 170°, this plane is now intersected by surface R3, which similar to R1 and R2 is also a plane that follows an arch circumference which is projected on the bar 29, wherein said arch that defines the surface R3 can have dimensions which vary between 0.1 mm and 0.5 mm. Said arch R3 is intersected on its other side by a plane described by a straight line which has an angle α which comes to an end on the light beam's 29 surface. The light beam's 29 lower part has a truncated cutting or notch 34, which is a plane described by a straight line with an angle ϕ which varies between 40° and 50°, allowing for a width varying between 1 mm and 2.5 mm.

A method to light the cavity 19 in which an electric control 26 sends a signal to the light emitter's switch which in turn powers the light emitter 27 above mentioned, followed by light emanating from said light source or light emitter 27 which concentrates into a light beam thanks to the optical collimator system 28 or a Fresnel arrangement in a different case; so that the light exiting the optical collimator system 27 or the Fresnel arrangement travels a distance through air between the optical collimator system 27 or the Fresnel arrangement and the upper surface of the light beam 29 found on the door 14, the light beam 29 transports the luminous flux until it finds along its path a notch which diverts said luminous flux and directs it into the cavity's 19 interior.

Having thus described in sufficient detail the present invention, it is found to have a good degree of inventive quality, being novel and its industrial application being evident, and in light of this the following are being claimed:

The invention claimed is:

1. An illumination system in an appliance cavity including a board or front knobs and defined by a roof, a floor, side walls, and one back wall, whose access is covered by a translucent access door and an optical collimator system or Fresnel arrangement, the system comprising:

a) an outer glass pane;

b) an inner glass pane;

c) at least two posts unto which both glass panes are mounted, d) a light guide with at least one notch placed on one of said at least two posts to light said cavity, wherein said light guide receives a light beam concentrated by the optical system placed on the board or front knobs, which in turn concentrates the light emanating from the source or light emitter, wherein the system is arranged as part of said access door, wherein the translucent door comprises two light guides placed on each of said at least two posts.

2. The system of claim 1, wherein said light emitter comprises an LED (light emitter diode).

3. The system of claim 1, wherein said light emitter comprises a bulb.

4. The system of claim 1, wherein said light emitter comprises a laser diode.

5. The system of claim 1, wherein said light emitter comprises an electroluminescent organic element.

6. The system of claim 1, wherein said light emitter comprises a field emission display screen.

7. The system of claim 1 wherein the appliance is selected from the group consisting of a stove, a kitchen, an oven, a refrigerator, a washer or a dish washer.

8. An illumination system in an appliance cavity defined by a roof, a floor, side walls, and one back wall, whose access is covered by a translucent access door with at least two translucent panels and an optical collimator system or Fresnel arrangement, the system comprising:

at least one guide light with at least one notch, the guide light being placed between said at least two translucent panels to light said cavity wherein said light guide receives a light beam concentrated by an optical system placed outside said door, which in turn concentrates the light emanating from a source or light emitter, wherein the source or light emitter is mounted on a heat-dissipating structure and forms an assembly with the optical system, the assembly affixed to an interior frame outside the access door of the appliance and thus not exposed to the environment of the appliance cavity.

9. An illumination system in an appliance cavity including a board or front knobs and defined by a roof, a floor, side walls, and a back wall, whose access is covered by a translucent access door and an optical collimator system or Fresnel arrangement, the system comprising:

a) an outer glass pane;

b) an inner glass pane;

c) a structural frame on which both glass panes are fastened;

d) a light guide with at least one notch placed on said structural frame to light said cavity, wherein said light guide receives a light beam, which is concentrated by the optical system placed in the front knobs or board, which in turn concentrates the light emanating from the source or light emitter, wherein the system is arranged as part of said access door, wherein said light emitter is mounted on a printed circuit board, wherein said printed circuit board is fastened to the optical collimator and wherein said printed circuit board and optical collimator are mechanically coupled to a fastener which is mechanically coupled to a flange located on the front board or front knobs.

10. A method to light an appliance cavity defined by a roof, a floor, side walls and a back wall whose access is covered by a translucent access door with at least two translucent panels, an optical collimator system or Fresnel arrangement, the method comprising:

mounting a light emitter on a heat-dissipating structure;

forming an assembly with the light emitter and the optical collimator system;

affixing the assembly to an interior frame outside the access door of the appliance and thus not exposing the assembly to the environment of the appliance cavity;

powering the light emitter;

concentrating the light emanating from said light emitter via the optical collimator system placed outside said door to generate a light beam to be cast unto a light guide;

receiving and propagating said light beam through the light guide;

lighting the cavity with a luminous flux resulting when the light beam encounters at least one notch placed over said light guide; and arranging the light guide, and said at least one notch as part of the access door.

11. The method of claim 10, wherein the arranging of the light guide, and said at least one notch is in an interior of the access door defined by said at least two translucent panels.

* * * * *